US011814928B2

(12) United States Patent
Balasubramanian et al.

(10) Patent No.: US 11,814,928 B2
(45) Date of Patent: Nov. 14, 2023

(54) ISOLATION VALVES

(71) Applicant: Schlumberger Technology Corporation, Sugar Land, TX (US)

(72) Inventors: Ganesh Balasubramanian, Rosharon, TX (US); Ashish Sharma, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 317 days.

(21) Appl. No.: 17/291,098

(22) PCT Filed: Nov. 4, 2019

(86) PCT No.: PCT/US2019/059633

§ 371 (c)(1),
(2) Date: May 4, 2021

(87) PCT Pub. No.: WO2020/096947

PCT Pub. Date: May 14, 2020

(65) Prior Publication Data

US 2022/0003074 A1 Jan. 6, 2022

Related U.S. Application Data

(60) Provisional application No. 62/755,901, filed on Nov. 5, 2018.

(51) Int. Cl.
*E21B 34/06* (2006.01)
*E21B 34/14* (2006.01)

(52) U.S. Cl.
CPC ..... *E21B 34/063* (2013.01); *E21B 34/14* (2013.01)

(58) Field of Classification Search
CPC .. E21B 2200/04; E21B 2200/06; E21B 34/14; E21B 34/063
See application file for complete search history.

(56) References Cited

U.S. PATENT DOCUMENTS

| | | | | |
|---|---|---|---|---|
| 6,662,877 | B2 | 12/2003 | Patel | |
| 7,597,151 | B2 | 10/2009 | Curtis et al. | |
| 7,617,876 | B2 | 11/2009 | Patel et al. | |
| 7,971,651 | B2 * | 7/2011 | Tanju | E21B 34/14 166/373 |
| 7,980,316 | B2 | 7/2011 | Swenson et al. | |
| 8,056,643 | B2 | 11/2011 | Basmajian et al. | |
| 8,640,779 | B2 | 2/2014 | Young et al. | |
| 2010/0108324 | A1 | 5/2010 | Tanju | |
| 2012/0097395 | A1 * | 4/2012 | McClung, III | H05B 6/6491 219/618 |

(Continued)

OTHER PUBLICATIONS

International Preliminary Report on Patentability issued in PCT application PCT/US2019/059633 dated May 20, 2021, 9 pages.

(Continued)

*Primary Examiner* — Christopher J Sebesta
(74) *Attorney, Agent, or Firm* — Matthew Goode

(57) ABSTRACT

A valve assembly that can be deployed in a subterranean well that includes a valve adapted to selectively isolate a region of the subterranean well, and a separating apparatus. The separating apparatus may further include at least one member being formed from a functional material and at least two sleeves connected by the at least one member.

19 Claims, 3 Drawing Sheets

(56) References Cited

U.S. PATENT DOCUMENTS

| | | | | |
|---|---|---|---|---|
| 2014/0041858 | A1* | 2/2014 | Sun | E21B 33/128 60/527 |
| 2018/0100376 | A1 | 4/2018 | Scott et al. | |
| 2018/0112486 | A1* | 4/2018 | Potts | E21B 43/11 |
| 2018/0179857 | A1* | 6/2018 | Themig | E21B 34/10 |
| 2018/0195366 | A1* | 7/2018 | MacDonald | E21B 17/046 |

OTHER PUBLICATIONS

International Search Report and Written Opinion issued in PCT application PCT/US2019/059633, dated Apr. 7, 2020 (12 pages).
Frangibolt—Aerospace, http://www.tinialloy.com/aero.htm, downloaded on May 4, 2021 (5 pages).

* cited by examiner

ISOLATION VALVES

CROSS-REFERENCE TO RELATED APPLICATION

The present document is based on and claims priority to U.S. Provisional Application Ser. No. 62/755,901, filed Nov. 5, 2018, which is incorporated herein by reference in its entirety.

BACKGROUND OF THE DISCLOSURE

The invention generally relates to systems and techniques to actuate isolation valves, such as formation isolation valves, for example.

A formation isolation valve may be used in a well for such purposes as preventing fluid loss and controlling an underbalanced condition. The valve forms a controllable sealed access to formations below the valve. When the valve is open, well equipment (a tubular string, a wireline system, a slickline system, etc.) may be deployed through the valve for purposes of performing one or more testing, perforating and/or completion functions below the valve. After these functions are complete, the well equipment may be retrieved, and the valve may be subsequently closed.

For purposes of opening and closing the valve, an intervention may be performed. In the intervention, a tool, such as a shifting tool, is run downhole into the well to engage and change the state of the valve. More specifically, the shifting tool interacts with a mechanical section of the valve. The mechanical section typically is tied to a barrier valve element (a ball valve element, for example) of the valve so that linear motion of the shifting tool (caused by controlled movement of a string connected to the shifting tool, for example) acts to either directly or indirectly open or close the valve element. In addition, the mechanical section holds the valve element in position (i.e., keeps the valve either open or closed) after the shifting tool is removed from the valve. After the formation isolation valve is closed, the well may be suspended for days or months.

A well intervention typically consumes a significant amount of time and money. Therefore, interventionless techniques have been developed to operate the formation isolation valve. For example, a conventional formation isolation valve may include a chamber that has precharged nitrogen, which acts as a gas spring for purposes of providing downhole power to operate the valve. More specifically, a control mechanism (a J-slot-based mechanism, for example) of the valve, which limits expansion of the nitrogen, may also be used that controls opening and closing of the valve by manipulating the well pressure. After a given sequence of well pressure fluctuations, the control mechanism allows the nitrogen to expand to push a piston for purposes of rotating a ball valve element of the valve open.

A potential challenge in using the above-described formation isolation valve with precharged nitrogen is that the gas chamber of the valve typically is charged on the rig floor next to rig personnel before the valve is run downhole and installed. In addition, under certain well conditions, the well pressure may exceed the rating of the tools in the well or the rating of the ball valve element during the sequence of pressure fluctuations.

Thus, there exists a continuing need for better ways to remotely actuate a downhole tool, such as a formation isolation valve, for example.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a valve assembly usable in a subterranean well, comprising: a valve adapted to selectively isolate a region of the subterranean well; and a separating apparatus comprised of: at least one member being formed from a functional material and at least two sleeves connected by the at least one member.

The present disclosure further introduces a method including sending an electrical signal to a separator apparatus comprised of a heating device member and at least one member comprised of a functional material, the at least one heating device member connected to the at least one member comprised of the functional material. The method also includes converting the electrical signal into thermal energy using the heating device member such that the at least one member separates into a plurality of pieces, and separating a first sleeve from a second sleeve such that a mandrel connected to the second sleeve is released. The method also includes transitioning a valve from a first state to a second state within a subterranean formation.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
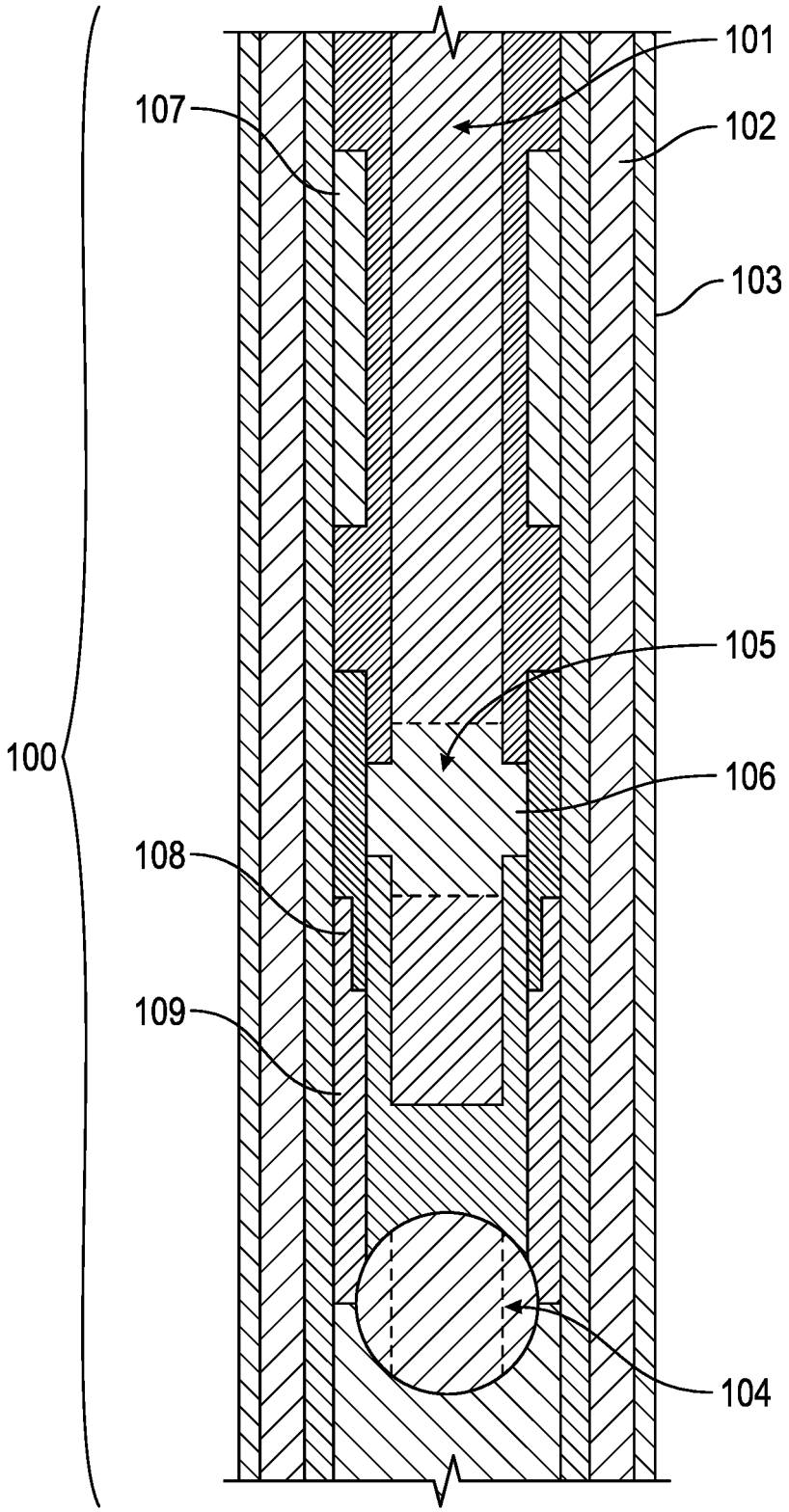
FIG. 1 depicts a schematic diagram of a formation isolation valve assembly at least according to at least a portion of an example implementation according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In the following description, numerous details are set forth to provide an understanding of the present disclosure. However, it may be understood by those skilled in the art that the methods of the present disclosure may be practiced without these details and that numerous variations or modifications from the described embodiments may be possible. At the outset, it should be noted that in the development of any such actual embodiment, numerous implementation-specific decisions may be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In the summary and this detailed description, each numerical value should be read once as modified by the term "about" (unless already expressly so modified), and then read again as not so modified unless otherwise indicated in context. Also, in the summary and this detailed description, it should be understood that a range listed or described as being useful, suitable, or the like, is intended to include support for any conceivable sub-range within the range at least because every point within the range, including the end points, is to be considered as having been stated. For example, "a range of from 1 to 10" is to be read as indicating each possible number along the continuum between about 1 and about 10. Furthermore, one or more of the data points in the present examples may be combined together, or may be combined with one of the data points in the specification to create a range, and thus include each possible value or number within this range. Thus, (1) even if numerous specific data points within the range are explicitly identified, (2) even if reference is made to a few specific data points within the range, or (3) even when no data points within the range are explicitly identified, it is to be understood (i) that the inventors appreciate and understand that any conceivable data point within the range is to be considered to have been specified, and (ii) that the inventors possessed knowledge of the entire range, each conceivable sub-range within the range, and each conceivable point within the range. Furthermore, the subject matter of this application illustratively disclosed herein suitably may be practiced in the absence of any element(s) that are not specifically disclosed herein.

Referring to FIG. 1, an embodiment of a formation isolation valve assembly 100 in accordance with the present disclosure controls access to a region of a well below the valve assembly 100. In this manner, the valve assembly 100 allows a string, such as a string 101, to pass through the valve assembly 100 to the region beneath the valve assembly 100 when the valve assembly 100 is in an open state (as depicted in FIG. 1), and when the valve assembly 100 is in a closed state, the valve assembly 100 seals off communication with the region beneath the valve assembly 100. An annular region, or annulus 102, that is located between an exterior surface of the valve assembly 100 and a production tubing 103 of the well may be sealed off by a packer (not shown).

More specifically, in some embodiments of the present disclosure, the valve assembly 100 includes a ball valve 104 that assumes an open state for the string 101 to pass through the valve assembly 100 and assumes a closed state to seal off the region below the valve assembly 100 when the string 101 no longer extends through the ball valve 104.

In some embodiments, when the formation isolation valve assembly 100 is first set in place downhole, the ball valve 104 may be opened (or run into the well bore open) to permit the string 101 to pass through. Alternatively, the formation isolation valve assembly 100 may be run with the string 101 already included through the ball valve 104. The string 101 may include a gravel packing tool to perform gravel packing operations downhole. After the gravel packing operations are complete, the string 101 may be withdrawn from the well bore.

After the gravel packing operation is complete, the ball valve 104 is closed. In this manner, the string 101 may include a shifting tool 105 (near a lower end of the string 101) to physically close the ball valve 104. More specifically, after lower end of the string 101 is retracted above the ball valve 104, a profiled section 106 of the shifting tool 105 engages (as described below) the valve assembly 100 and is operated in a manner (described below) to cause the ball valve 104 to close.

The valve assembly 100 also includes an operator mandrel 107 that moves up in response to applied tubing pressure (in the central passageway of the assembly 100) and moves down when trigger mechanism (described below) is released. The downward travel of the operator mandrel 107 causes the mandrel 107 to contact a collet actuator 108 that is engaged with a ball valve operator mandrel 109 that, in turn, operates the ball valve 104. In this manner, the downward movement of the operator mandrel 107 causes the ball valve operator mandrel 109 to move in a downward direction to open the ball valve 104.

In other embodiments, to close the ball valve 104 via the shifting tool 105, the profiled section 106 of the shifting tool 105 engages (as described below) the collet actuator 108 to force the collet actuator 108 up and down. On each upward stroke, the collet actuator 108 disengages from the ball valve operator mandrel 109, as described below.

When the ball valve operator mandrel 109 moves up by a predetermined distance, the mandrel 109 closes the ball valve 104. After the cycles occur, the ball valve operator mandrel 109 engages with the collet actuator 108 on the downstoke and remains engaged with the collet actuator 108 on the upstroke of the collet actuator 108, thereby permitting the shifting tool 105 to lift the ball valve operator mandrel 109 up for a sufficient distance to close the ball valve 104. The shifting tool 105 has nothing to do with the cycling mechanism of the ball valve 104. The shifting tool 105 is used when the cycling mechanism fails or in formation isolation valves with no cycling mechanism. The cycling mechanism on the other hand is used to open the ball valve 104 remotely without intervention (by using any tool). Both are independent of each other. The ball valve 104 can be opened or closed independently by the shifting tool 105. The shifting tool 105 has the necessary profiles to shift the ball valve operator mandrel 109 downhole to open the ball valve 104 and shift the ball valve operator mandrel 109 uphole to close the ball valve 104.

Figure 2:
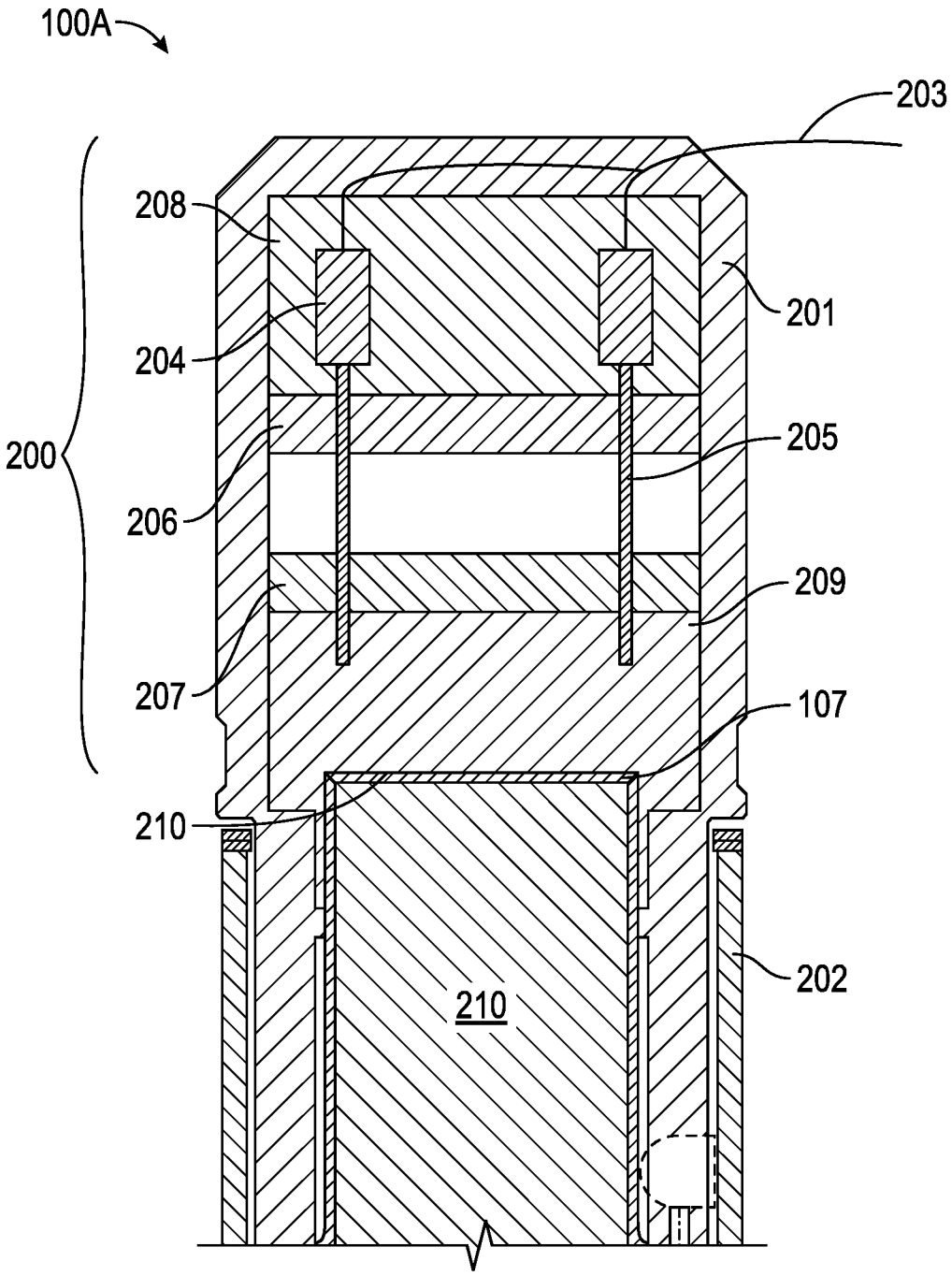
FIGS. 2-3 depict more detailed schematic diagrams of sections of a formation isolation valve assembly according to at least a portion of an example implementation according to one or more aspects of the present disclosure.
Figure 3:
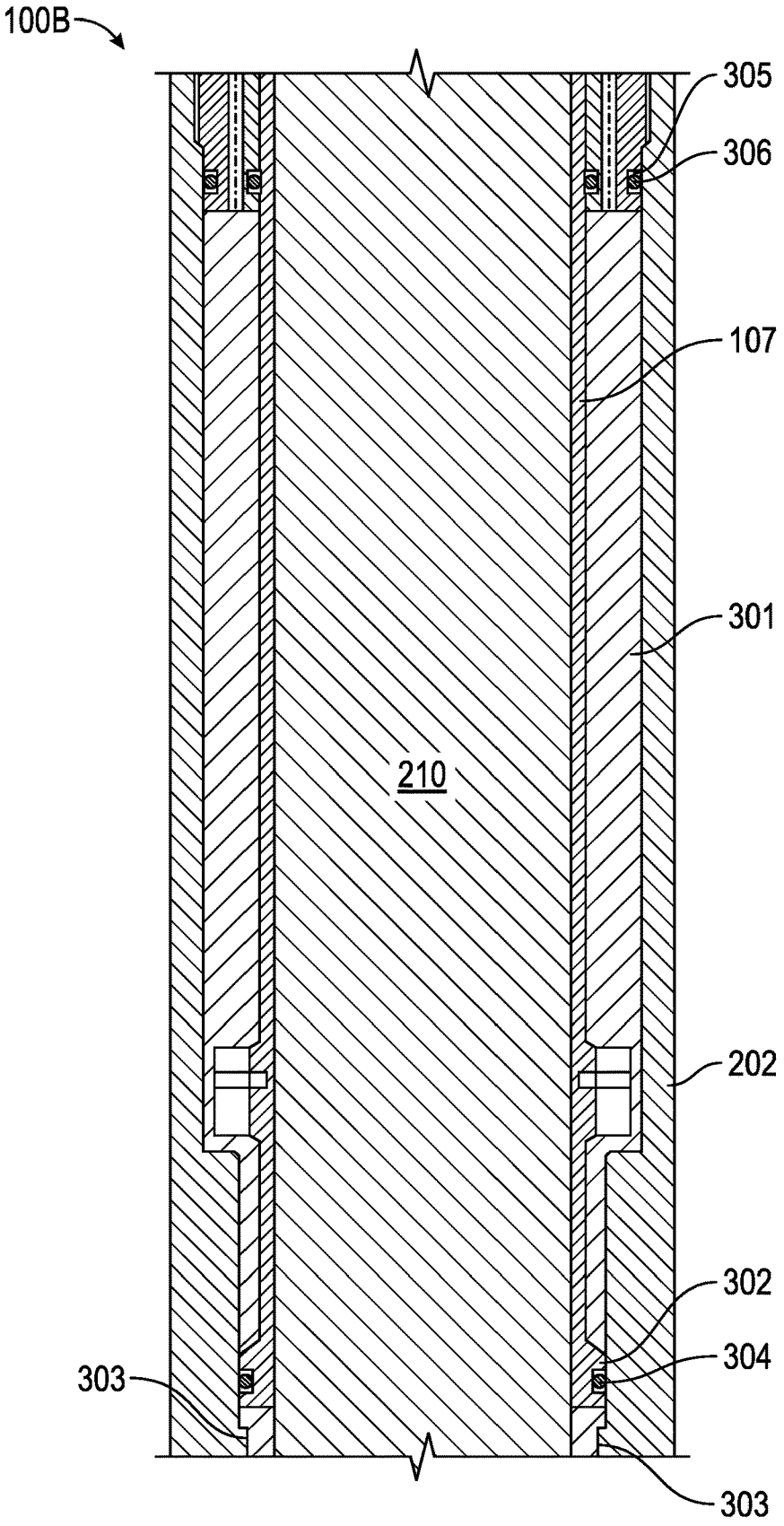

Referring to the formation isolation valve assembly 100 in more detail, FIGS. 2, and 3 depict sections 100A and 100B that form a section (of the valve assembly 100) that houses the release module 200 and the mandrel 107. The upper part of this section is formed from an upper housing section 201 that mates with a lower housing section 202. In this manner, the lower end of the upper housing section 201 is received into a bore in the upper end of the housing section 202. Both housing sections 201 and 202 are generally cylindrical and circumscribe a longitudinal axis of the valve assembly 100.

In other embodiments and illustrated in FIG. 2., the upper housing 201 contains the release module 200. The release module 200 is an example of a type of separating apparatus, which may contain of one or more fracturing bolts 205 arranged longitudinally to circumscribe a vertical axis of the valve assembly 100. The fracturing bolt 205 is a type of coupling mechanism (e.g., pins, screw or rods) that is (1) configured to couple at least two objects together and (2) at a predetermined point in time, can be configured to separate or fracture. As used herein the terms "separate" or "fracture" are defined to be the loss of a connecting mechanism such that after release, the object is in at least two separate pieces. In this case, the fracturing bolt 205 couples at least two cages (actuator cage 208 and release cage 209) together, which provide additional support, stability and security for the fracturing bolts 205. The fracturing bolt 205 is contained/secured in at least a portion of the actuator cage 208 and release cage 209 such that at least a portion of the fracturing bolt 205 is located on the surface of the actuator cage 208 and the release cage 209. The actuator cage 208 contacts the upper support sleeve 206 and the release cage 209 contacts the lower support sleeve 207, the upper support sleeve 206 and the lower support sleeve 207 both being arranged about a longitudinal axis of the valve assembly 100. The fracturing bolt 205 may be comprised of a threaded or unthreaded cylindrical shaft having an optional head member attached to the cylindrical shaft. Regardless of the head/shaft arrangement, the shaft is comprised of a shaped memory alloy.

The fracturing bolt 205 is considered to be pre-strained or pre-loaded to a predetermined strain value. In other words, the fracturing bolt 205 is pre-strained when its structure has been deformed using an applied force. For example, the fracturing bolt 205 may be pre-strained by applying a sufficient force to both ends of the bolt causing the deformation (i.e., shrinking) of the fracturing bolt 205. The fracturing bolt 205 may be comprised of a functional material such as a shape memory material in the martensitic phase at ambient and operating temperatures. Other examples of functional materials include piezoelectric materials, magnetostriction materials, electrorheological fluids and shaped memory plastics.

Upon receiving an electrical signal from the one or more wires 203, the heating connector 204 converts the received electrical signal to a heat source (joule heating) causing a phase change to a high temperature austenitic phase such that fracturing bolt 205 fractures (i.e., separates into at least two pieces and/or experiences a reduction in length). This results in a crystal structure change in the grains of the bolt material, causing the fracturing bolt 205 to shorten in length. Since the fracturing bolt 205 is secured at both the ends to the actuator cage 208 and the release cage 209 respectively, it results in its fracture, thereby releasing the operator mandrel 107 and opening the ball valve 104. According to one or more embodiments of the present disclosure, the electrical signal can be sent to the release module 200 through a control line or wire 203 running from surface to the isolation valve downhole that is directly connected to the release module 200, to enable fracturing of the fracturing bolt 205 at the desired time. In alternative embodiments, a battery pack (not shown) can also be built into the smart release module 200 that can be activated remotely through a radiofrequency signal from the surface to provide the necessary electrical voltage required for fracturing the bolt.

As discussed above, the operator mandrel 107 moves up in response to applied tubing pressure in a central passageway 210 of the valve assembly 100. However, the fracturing of the fracturing bolt 205 separates the connection between the upper support sleeve 206 and the lower support sleeve 207 causing the operator mandrel 107 to move down in response to the pressure exerted by a gas chamber 301 (FIG. 3). The gas chamber 301, in some embodiments, is formed from an annularly recessed cavity located between the upper housing section 201 and the operator mandrel 107. The gas chamber 301, in other embodiments of the invention, may include either atmospheric pressure or compressed nitrogen gas. However, in other embodiments, the gas chamber 301 may be replaced by a compression spring or another type of spring, which would enable mechanical engagement with the downhole sections discussed above to open the ball valve 104 of the valve assembly 100.

The responsiveness of the operator mandrel 107 to the tubing pressure and the pressure that is exerted by the gas in the chamber 301 is attributable to an upper annular surface 302 of the mandrel 107 that is in contact with the gas in the gas chamber 301 and a lower annular surface 303 of the ball valve operator mandrel 109 that is in contact with the fluid in the central passageway 210. Therefore, when the fluid in the central passageway 210 exerts a force (on the lower annular surface 303) that is sufficient to overcome the force that the gas in the chamber 301 exerts on the upper annular surface 302, a net upward force is established on the mandrel 107. Otherwise, a net downward force is exerted on the mandrel 107 (i.e., piston effect) to force the ball valve operator mandrel 109 down. In other words, the potential energy stored in the chamber 301 in the form of compressed nitrogen gas or spring pushes the ball valve operator mandrel 109 downhole like a piston. This causes the ball valve operator mandrel 109 to engage and push a latch nut and other connected mandrels (not shown) in the mechanical section of the valve assembly.

Referring to FIG. 3, the mandrel 107 includes an exterior annular notch to hold O-rings 304 to seal off the bottom of the gas chamber 301. O-rings 305 are also located in an interior annular notch of the upper housing section 201 (see FIG. 3) to form a seal between the upper housing 201 and the operator mandrel 107 to seal off the gas chamber 301. O-rings 306 form a seal between the upper housing sections 201 and the lower housing section 202.

In view of the entirety of the present disclosure, including the figures and the claims, a person having ordinary skill in the art will readily recognize that the present disclosure introduces a valve assembly usable in a subterranean well, comprising: a valve adapted to selectively isolate a region of the subterranean well; and a separating apparatus comprised of: at least one member being formed from a functional material and at least two sleeves connected by the at least one member.

For example, the separating apparatus may further comprise a heating device member connected to the at least one member. The separating apparatus may further comprise an electrical wire connected to the heating device member such that when an electrical current is applied to the heating device member, the at least two sleeves are no longer connected by the at least one member. The separating apparatus may further comprise an actuator cage and a release cage, the actuator cage and the release cage being arranged longitudinally about a vertical axis of the valve assembly.

For example, the valve assembly may further comprise a mandrel to be operated by pressure to transition the valve from a first state to a second state. The first state is a closed state and the second state is an open state.

The valve assembly may also comprise a charge chamber located between a mandrel and a housing of the valve assembly, wherein the charge chamber contains atmospheric pressure, compressed nitrogen or a compression spring.

The functional material may be a material selected from the group consisting of shaped memory alloys, piezoelectric materials, magnetostriction materials, electrorheological fluids, shaped memory plastics and combinations thereof.

The present disclosure also introduces a method comprising: sending an electrical signal to a separator apparatus comprised of a heating device member and at least one member comprised of a functional material, the at least one heating device member connected to the at least one member comprised of the functional material; converting the electrical signal into thermal energy using the heating device member such that the at least one member separates into a plurality of pieces; separating a first sleeve from a second sleeve such that a mandrel connected to the second sleeve is released; and transitioning a valve from a first state to a second state within a subterranean formation.

For example, the mandrel may be operated by pressure to transition the valve from a first state to a second state such that the first state is a closed state and the second state is an open state.

The sending may further comprise sending an electrical signal via one or more wires connected to the separator apparatus, or sending a wireless electrical signal to the separator apparatus.

The valve may be a formation isolation valve. The separating apparatus may further comprise an actuator cage and a release cage, the actuator cage and the release cage being arranged longitudinally about a vertical axis of the valve assembly.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' or 'step for' together with an associated function without the recitation of structure.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. A valve assembly usable in a subterranean well, comprising:

a valve adapted to selectively isolate a region of the subterranean well and comprising a mandrel selectively releasable to operate the valve; and a separating apparatus comprised of:

a first sleeve;

a second sleeve coupled to the mandrel;

a member being formed from a functional material and extending through the first sleeve and the second sleeve to couple the first sleeve to the second sleeve and restrain the mandrel; and a heating device member connected to the member and operable to heat the member when an electrical current is applied to the heating device member to fracture the member and decouple the first sleeve from the second sleeve to release the mandrel.

2. The valve assembly of claim 1, wherein the separating apparatus further comprises an electrical wire connected to the heating device member such that when an electrical current is applied to the heating device member, the first sleeve and the second sleeve are no longer connected by the member.

3. The valve assembly of claim 1, wherein the separating apparatus further comprises an actuator cage and a release cage, the actuator cage and the release cage being arranged longitudinally about a vertical axis of the valve assembly.

4. The valve assembly of claim 1, wherein the valve assembly further comprises a mandrel to be operated by pressure to transition the valve from a first state to a second state.

5. The valve assembly of claim 4, wherein the first state is a closed state and the second state is an open state.

6. The valve assembly of claim 1, further comprising a charge chamber located between the mandrel and a housing of the valve assembly.

7. The valve assembly of claim 6, wherein the charge chamber contains atmospheric pressure or compressed nitrogen.

8. The valve assembly of claim 6, wherein the charge chamber contains a compression spring.

9. The valve assembly of claim 1, wherein the functional material is a material selected from the group consisting of shaped memory alloys, piezoelectric materials, magnetostriction materials, electrorheological fluids, shaped memory plastics and combinations thereof.

10. The valve assembly of claim 1, wherein the functional material is a shaped memory alloys.

11. A method comprising:

sending an electrical signal to a separator apparatus comprised of a heating device member and a member comprised of a functional material, the heating device member connected to the member comprised of the functional material and the member extending through a first sleeve of the separator apparatus and a second sleeve of the separator apparatus to couple the first sleeve to the second sleeve and restrain a mandrel connected to the second sleeve;

converting the electrical signal into thermal energy using the heating device member such that the member fractures into a plurality of pieces to decouple the first sleeve from the second sleeve such that the mandrel is released; and transitioning a valve from a first state to a second state within a subterranean formation via the released mandrel.

12. The method of claim 11, wherein the mandrel is operated by pressure to transition the valve from a first state to a second state.

13. The method of claim 11, wherein the first state is a closed state and the second state is an open state.

14. The method of claim 11, wherein the sending comprises sending an electrical signal via one or more wires connected to the separator apparatus.

15. The method of claim 11, wherein the sending comprises sending a wireless electrical signal to the separator apparatus.

16. The method of claim 11, wherein the functional material is a material selected from the group consisting of shaped memory alloys, piezoelectric materials, magnetostriction materials, electrorheological fluids, shaped memory plastics and combinations thereof.

17. The method of claim 11, wherein the functional material is a shaped memory alloys.

18. The method of claim 11, wherein the valve is a formation isolation valve.

19. The method of claim 11, wherein the separating apparatus further comprises an actuator cage and a release cage, the actuator cage and the release cage being arranged longitudinally about a vertical axis of the valve.

* * * * *